US009557682B2

(12) United States Patent
Sugiura et al.

(10) Patent No.: US 9,557,682 B2
(45) Date of Patent: Jan. 31, 2017

(54) RESIN-COATED CARRIER FOR ELECTROPHOTOGRAPHIC DEVELOPER AND ELECTROPHOTOGRAPHIC DEVELOPER USING THE RESIN-COATED CARRIER

(75) Inventors: Takao Sugiura, Kashiwa (JP); Tetsuya Igarashi, Kashiwa (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 13/435,316

(22) Filed: Mar. 30, 2012

(65) Prior Publication Data

US 2012/0251191 A1 Oct. 4, 2012

(30) Foreign Application Priority Data

Mar. 31, 2011 (JP) ..... 2011-079169
Mar. 23, 2012 (JP) ..... 2012-066462

(51) Int. Cl.

| | |
|---|---|
| ***G03G 9/00*** | (2006.01) |
| ***G03G 15/08*** | (2006.01) |
| *G03G 9/10* | (2006.01) |
| *G03G 9/107* | (2006.01) |
| *G03G 9/113* | (2006.01) |

(52) U.S. Cl.
CPC ..... *G03G 15/0818* (2013.01); *G03G 9/10* (2013.01); *G03G 9/107* (2013.01); *G03G 9/113* (2013.01)

(58) Field of Classification Search
CPC .... G03G 15/0818; G03G 9/107; G03G 9/113; G03G 9/10
USPC ..... 430/111.1–111.41
See application file for complete search history.

(56) References Cited

U.S. PATENT DOCUMENTS

| | | | | |
|---|---|---|---|---|
| 4,264,697 | A * | 4/1981 | Perez et al. | 430/108.21 |
| 6,210,850 | B1 | 4/2001 | Ogata et al. | |
| 2006/0269862 | A1 | 11/2006 | Kobayashi et al. | |
| 2007/0048649 | A1 | 3/2007 | Kobayashi et al. | |
| 2009/0176170 | A1* | 7/2009 | Sugiura et al. | 430/111.31 |
| 2009/0246526 | A1 | 10/2009 | Sugiura et al. | |
| 2010/0248116 | A1 | 9/2010 | Kamoto et al. | |
| 2011/0013948 | A1 | 1/2011 | Aga et al. | |
| 2012/0028186 | A1* | 2/2012 | Nakamura et al. | 430/137.13 |

FOREIGN PATENT DOCUMENTS

| | | | |
|---|---|---|---|
| JP | 5-040367 | | 2/1993 |
| JP | H08-069131 | A | 3/1996 |
| JP | 2000-235283 | A | 8/2000 |
| JP | 2006-337579 | | 12/2006 |
| JP | 2007-057943 | | 3/2007 |
| JP | 2008-310104 | | 12/2008 |
| JP | 2009-175666 | | 8/2009 |
| JP | 2009-234839 | A | 10/2009 |
| JP | 2009-244572 | | 10/2009 |
| JP | 2010-237525 | A | 10/2010 |
| JP | 2010-250281 | A | 11/2010 |

OTHER PUBLICATIONS

Japanese Office action issued with respect to application No. 2012-066462, mail date is Nov. 9, 2015.

* cited by examiner

*Primary Examiner* — Christopher Rodee
*Assistant Examiner* — Omar Kekia
(74) *Attorney, Agent, or Firm* — Greenblum & Bernstein, P.L.C.

(57) ABSTRACT

Object of the present invention is to provide a resin-coated carrier for an electrophotographic developer with reduced carrier weight, carrier beads carry over is prevented, and further, excellent in carrier strength and stable charging property in endurance printing. To achieve the object, the carrier having a coated resin layer on the surface of a porous ferrite core material and the pore volume and the peak pore size of the porous ferrite core material are 55 to 160 $mm^3/g$ and 0.2 to 0.7 μm, respectively, and an electrophotographic developer using the resin-coated carrier is adopted.

12 Claims, No Drawings

RESIN-COATED CARRIER FOR ELECTROPHOTOGRAPHIC DEVELOPER AND ELECTROPHOTOGRAPHIC DEVELOPER USING THE RESIN-COATED CARRIER

BACKGROUND OF THE INVENTION

Field of the Invention

The present invention relates to a resin-coated carrier for an electrophotographic developer used in a two-component electrophotographic developer for use in apparatuses such as copiers and printers, and an electrophotographic developer using the resin-coated carrier.

Description of Related Art

An electrophotographic development method is a method in which development is performed by adhering the toner particles in a developer to the electrostatic latent image formed on a photo conductor, and the developer used in such a method is classified into a two-component developer composed of toner particles and carrier particles and a one-component developer using only toner particles.

As a development method using, among such developers, a two-component developer composed of toner particles and carrier particles, previously a method such as a cascade method has been adopted, but currently a magnetic brush method using a magnet roll predominates.

In a two-component developer, the carrier particles serve as a carrying substance to form a toner image on the photo conductor in such a way that the carrier particles are stirred together with the toner particles in a developer box filled with the developer to impart an intended charge to the toner particles, and further, convey the thus charged toner particles to the surface of the photo conductor to form the toner image on the photo conductor. The carrier particles remaining on a development roll which holds a magnet again return from the development roll into the developer box to be mixed under stirring with the fresh toner particles and to be repeatedly used for a predetermined period of time.

In contrast to a one-component developer, a two-component developer is such that the carrier particles are mixed under stirring with the toner particles, thus charge the toner particles, and further have a function to convey the toner particles, and a two-component developer is excellent in the controllability in designing developers. Accordingly, two-component developers are suitable for full-color development apparatuses required to offer high image quality and for high speed printing apparatuses required to be satisfactory in the reliability and durability in image maintenance.

In two-component developers used in the above-described manner, the image properties such as the image density, fogging, white spots, gradation and resolution are each required to exhibit a predetermined value from the initial stage, and further these properties are required to be invariant and to be stably maintained during the endurance printing. For the purpose of stably maintaining these properties, the properties of the carrier particles contained in the two-component developers are required to be stable.

As the carrier particles which form two-component developers, there have hitherto been used various types of iron powder carriers, ferrite carriers, resin-coated ferrite carriers, magnetic powder-dispersed resin carriers and the like.

Recently, office networking has been promoted, and the age of monofunctional copiers develops into the age of multifunctional copiers; the service system has also shifted from the age of the system such that a contracted service man conducts periodic maintenance inclusive of the replacement of the developer to the age of the maintenance-free system; thus, the market has further enhanced demand for further longer operating life of the developer.

Under such circumstances, for the purpose of reducing the carrier particle weight and extending the developer operating life, there have been proposed in Japanese Patent Laid-Open No. 5-40367 and the like a variety of magnetic powder-dispersed carriers in each of which magnetic fine particles are dispersed in a resin.

Such magnetic powder-dispersed carriers can be reduced in true density by decreasing the amounts of the magnetic fine particles and can be reduced in stress caused by stirring, and hence can be prevented from the abrasion and exfoliation of the coating film and accordingly can offer stable image properties over a long period of time.

However, the magnetic powder-dispersed carrier is prepared by agglomerating magnetic fine particles with a binder resin, and hence offers, as the case may be, a problem that the magnetic fine particles are detached due to the stirring stress or the impact in the developing device or a problem that the carrier particles themselves are cracked probably because the magnetic powder-dispersed carriers are inferior in mechanical strength to the iron powder carriers and ferrite carriers having hitherto been used. The detached magnetic fine particles and the cracked carrier particles adhere to the photo conductor to cause image defects as the case may be.

Additionally, the magnetic powder-dispersed carrier uses magnetic fine particles, and accordingly has a drawback that the residual magnetization and the coercive force are high and the fluidity of the developer is degraded. In particular, when a magnetic brush is formed on a magnet roll, the presence of the residual magnetization and the coercive force hardens the ears of the magnetic brush and hence high image quality is hardly obtained. Additionally, even when the magnetic powder-dispersed carrier is separated away from the magnet roll, the magnetic coagulation of the carrier is not unstiffened and the mixing of the carrier with the refilled toner is not rapidly conducted, and hence there occurs a problem that the charge amount rise is aggravated, and image defects such as toner scattering and fogging are caused.

In addition to such a magnetic powder-dispersed carrier, for the purpose of reducing the weight of the carrier particle, there have been proposed hollow carriers in which a vacancy is formed in the interior of the carrier core material particle. For example, Japanese Patent Laid-Open No. 2008-310104 states that the core particle has at least one vacancy of 20% or more and 60% or less with reference to the cross-sectional area, and the total porosity is 20% or more and 70% or less with reference to the cross-sectional area. Japanese Patent Laid-Open No. 2009-244572 states that when the outer diameter of the carrier core material is represented by $d_1$ and the outer diameter of the hollow portion present in the interior of the core material is represented by $d_2$, it is preferable for the relation $0.1<d_2/d_1<0.9$ to be satisfied.

In the carriers described in these patent documents, the weight reduction is certainly attained; however, in any of these carriers, the size of one vacancy is extremely large, and hence, as compared to conventional ferrite carriers having no hollow portion, these carriers are still weak in mechanical strength, thus the fracture of the carrier particles occurs due to the stirring stress or the impact in the developing device at the time of endurance printing, and the fractured particles adhere to the photo conductor to offer a cause for the occurrence of image defects. Accordingly, for the extension of the operating life having been recently, particularly demanded, these carriers are absolutely unsatisfactory.

Further, as the substitutes for such magnetic powder-dispersed carriers and hollow carriers, resin-filled carriers obtained by filling a resin in the voids of porous carrier core material have been proposed.

Japanese Patent Laid-Open No. 2006-337579 proposes a resin-filled carrier prepared by filling a resin in a ferrite core material having a porosity of 10 to 60%, and Japanese Patent Laid-Open No. 2007-57943 proposes a resin-filled carrier having a three-dimensional laminated structure. Further, Japanese Patent Laid-Open No. 2009-175666 proposes a resin-filled carrier which has a high dielectric breakdown voltage and has improved fracture strength of the carrier particle, through the specification of the pore volume, the pore size and the pore size distribution property of the porous ferrite core material to be filled with a resin.

In each of the resin-filled carriers described in these patent documents, a resin is filled even in the interior of the porous ferrite particles to form a three-dimensional laminated structure. In particular, in Japanese Patent Laid-Open No. 2009-175666, the pore size distribution property is controlled more accurately, and hence the variation of the resin filling degree is reduced, and further, it is stated that the surface of the filling resin is preferably coated with a resin. Therefore, indeed the weight reduction of the carrier particle is attained, and the carrier strength is improved; however, the carrier particle itself is made to have a high resistance and further made to have a three-dimensional structure composed of the resin and the ferrite, and hence a capacitor-like function works to cause a problem that the charge amount is increased at the time of endurance printing due to the accumulation of the charge, to make it difficult to ensure the image density and to obtain images high in image quality. Accordingly, for the extension of the operating life having been recently demanded, these carriers are far from being satisfactory, in a manner similar to hollow carriers.

On the other hand, achieved weight reduction makes magnetization per a carrier particle lower and as a result, problems such as defective image caused by scattering of a carrier from a magnetic brush to a photo conductor, i.e. easy generation of a carrier beads carry over has been arisen.

Therefore, with respect to the demand for extension of operating life, demanded is a carrier for an electrophotographic developer in which, while achieving the weight reduction, preventing the image defects such as a carrier beads carry over, further the carrier strength is being attained, and additionally the charging property is stabilized at the time of endurance printing.

As described above, there has been demanded a carrier for an electrophotographic developer in which, while the weight reduction is being attained, the defective image such as a carrier beads carry over is prevented and further the carrier strength is high, and additionally the charge amount variation is small at the time of endurance printing.

SUMMARY OF THE INVENTION

Accordingly, an object of the present invention is to provide a resin-coated carrier for an electrophotographic developer in which, while the weight reduction is being attained, the carrier beads carry over is prevented, further the carrier strength of the particle is high, and additionally the charging property is stabilized at the time of endurance printing, and an electrophotographic developer using the resin-coated carrier.

For the purpose of solving the above-described problems, the present inventors conducted a diligent study and therefore reached the present invention by discovering that the above-described problems are solved by forming a coated resin layer on the surface of a porous ferrite core material (particle) having specific pore properties so as to form in the interior of the particle a space closed from the carrier surface, by thus attaining the weight reduction and the improvement of the carrier strength, and by thus suppressing the charge variation, in particular the charge increase at the time of endurance printing through the absence of the resin in the interior of the particle.

Specifically, the present invention provides a resin-coated carrier for an electrophotographic developer, wherein the carrier has a coated resin layer on the surface of a porous ferrite core material, and the pore volume and the peak pore size of the porous ferrite core material are 55 to 160 $mm^3/g$ and 0.2 to 0.7 μm, respectively.

In the resin-coated carrier for an electrophotographic developer according to the present invention, preferably the pore size variation dv represented by the following formula (I) in the pore size distribution of the porous ferrite core material is 1.0 or less:

[Expression 1]

$$Dv==|d_{84}-d_{16}|/2 \quad (1)$$

wherein $d_{16}$: the pore size calculated from the pressure applied to the mercury when the intrusion amount reaches 16%, wherein the total amount of the intruded mercury in the high pressure region is defined as 100%, and $d_{84}$: the pore size calculated from the pressure applied to the mercury when the intrusion amount reaches 84%, wherein the total amount of the intruded mercury in the high pressure region is defined as 100%.

In the resin-coated carrier for an electrophotographic developer according to the present invention, preferably the apparent density of the porous ferrite carrier core material is 1.0 to 2.0 $g/cm^3$.

In the resin-coated carrier for an electrophotographic developer according to the present invention, preferably the fine powder coverage factor of the porous ferrite carrier core material is 6.0% or less.

In the resin-coated carrier for an electrophotographic developer according to the present invention, preferably the coating amount of the coated resin layer is 0.5 to 5 parts by weight in relation to 100 parts by weight of the porous ferrite core materials.

In the resin-coated carrier for an electrophotographic developer according to the present invention, preferably the volume average particle size is 20 to 60 μm.

In the resin-coated carrier for an electrophotographic developer according to the present invention, preferably the saturation magnetization is 30 to 80 $Am^2/kg$.

In the resin-coated carrier for an electrophotographic developer according to the present invention, preferably the apparent density is 1.0 to 2.0 $g/cm^3$.

In the resin-coated carrier for an electrophotographic developer according to the present invention, the coated resin layer is preferably formed by a dry coating method.

The present invention also provides an electrophotographic developer including any one of the above-described resin-coated carriers and a toner.

The electrophotographic developer according to the present invention is a refill developer.

The resin-coated carrier for an electrophotographic developer according to the present invention can attain the weight reduction and the improvement of the carrier strength and can stabilize the charging property at the time of endurance printing by forming a space closed from the carrier surface in the interior of the particle by providing a coated resin layer on the surface of a porous ferrite core material having a specific pore volume and a specific peak pore size and by filling no resin in the voids of the porous ferrite core material. Therefore, the electrophotographic developer using the resin-coated carrier is excellent in durability and enables the extension of the operating life to be attained.

DETAILED DESCRIPTION OF THE EMBODIMENTS

Hereinafter, the embodiments for carrying out the present invention are described.

<Resin-Coated Carrier for an Electrophotographic Developer According to the Present Invention>

The resin-coated carrier for an electrophotographic developer according to the present invention is obtained by coating with a resin the surface of a porous ferrite core material, namely, a porous ferrite particle. The porous ferrite core material preferably includes at least one selected from Mn, Mg, Li, Ca, Sr, Cu and Zn. In consideration of the recent trend of the environmental load reduction including the waste regulation, it is preferable not to contain the heavy metals Cu, Zn and Ni each in a content exceeding an inevitable impurity (associated impurity) range.

The pore volume of the porous ferrite core material is 55 to 160 $mm^3/g$, preferably 55 to 100 $mm^3/g$ and more preferably 60 to 80 $mm^3/g$. When the pore volume of the porous ferrite core material is less than 55 $mm^3/g$, no sufficient vacancy can be ensured in the interior of the carrier after resin coating, and hence no weight reduction can be attained. When the pore volume of the porous ferrite core material exceeds 160 $mm^3/g$, the volume of the vacancy formed in the interior of the carrier after resin coating is large, and hence it is impossible to maintain the carrier strength.

The peak pore size of the porous ferrite core material is 0.2 to 0.7 μm and preferably 0.3 to 0.6 μm. When the peak pore size of the porous ferrite core material is less than 0.2 μm, the area density of the asperities on the core material surface is small, and hence the carrier surface after resin coating becomes flat and smooth and the triboelectric charging with the toner is not performed efficiently; thus, to the carrier low in specific gravity, no sufficient stress with the toner is given to degrade the charging rise. When the peak pore size of the porous ferrite core material exceeds 0.7 μm, it is difficult to coat only the surface with a resin, the resin impregnates into even the interior of the pores, the raised portions of the core material are exposed or the resin coating thickness is decreased; thus, such a peak pore size unpreferably offers the causes for, in the initial stage, the non-attainment of the targeted resistance and the targeted charging property, and the charge leakage, and offers the causes for, also at the time of endurance printing, the resistance variation and the charge variation due to the abrasion at the raised portions.

As described above, the pore volume and the peak pore size falling within the above-described ranges enable to obtain a resin-coated ferrite carrier which is free from the above-described failures and is appropriately reduced in weight.

[Pore Size and Pore Volume of the Porous Ferrite Core Material]

The measurement of the pore size and the pore volume of the porous ferrite core material was conducted as follows. Specifically, the measurement was conducted with the mercury porosimeters, Pascal 140 and Pascal 240 (manufactured by Thermo Fisher Scientific K.K.). A dilatometer CD3P (for powder) was used, and a sample was put in a commercially available gelatin capsule with a plurality of bored holes and the capsule was placed in the dilatometer. After deaeration with Pascal 140, mercury was charged and a measurement in the lower pressure region (0 to 400 kPa) was conducted as a first run. Successively, the deaeration and another measurement in the lower pressure region (0 to 400 kPa) were conducted as a second run. After the second run, the total weight of the dilatometer, the mercury, the capsule and the sample was measured. Next, a high pressure region (0.1 MPa to 200 MPa) measurement was conducted with Pascal 240. From the amount of the intruded mercury as measured in the high pressure region measurement, the pore volume, the pore size distribution and the peak pore size of the porous ferrite core material were derived. The pore size was derived with the surface tension and the contact angle of mercury of 480 dyn/cm and 141.3°, respectively.

In the pore size distribution of the porous ferrite core materials, the pore size variation dv is preferably 1.0 or less. Here, the total amount of the intruded mercury in the high pressure region is defined as 100%, and the pore size calculated from the pressure applied to the mercury when the intrusion amount reaches 84% is defined as $d_{84}$ and the pore size calculated from the pressure applied to the mercury when the intrusion amount reaches 16% is defined as $d_{16}$. The value of dv is calculated from the following formula (1):

[Expression 2]

$$Dv=|d_{84}-d_{16}|/2 \quad (1)$$

The pore size variation dv of the porous ferrite core material exceeding 1.0 means that the variation of the asperities among the particles and the variation of the shape of the core material among the particles become large. Accordingly, when the dv value exceeds an intended range, the variation among particles tends to occur with respect to the particle shape and the aggregation due to the resin coating, and therefore, such a variation offers a cause for the degradation of the charging rise or for the increase of the charge variation.

In the resin-coated carrier for an electrophotographic developer according to the present invention, the apparent density of the porous ferrite carrier core material is preferably 1.0 to 2.0 $g/cm^3$, more preferably 1.3 to 1.8 $g/cm^3$ and the most preferably 1.5 to 1.7 $g/cm^3$. When the apparent density exceeds 2.0 $g/cm^3$, reduction of the carrier weight is not enough and it makes durability poor. On the other hand, when the apparent density is less than 1.0 $g/cm^3$, weight of the carrier is too light and it easily makes charge imparting capability poor.

<Apparent Density>

Apparent density is measured according to the procedure provided in JIS-Z2504, Metallic powders—Determination of apparent density—Funnel method.

In the resin-coated carrier for an electrophotographic developer according to the present invention, the fine powder coverage factor of the porous ferrite carrier core material is preferably 6.0% or less and more preferably 3.0% or less. The fine powder coverage factor of the porous ferrite carrier core material (porous ferrite particles) described here is the existence ratio of an ultra fine powder of about 1 to 2 μm level or less exists on the surface of the porous ferrite core material. When such an ultra fine powder exists on the surface of the porous ferrite carrier particle, those may exist after coating the resin and it might be cause of a carrier beads carry over. When the fine powder coverage factor exceeds 6.0%, defectives in an image caused by a carrier beads carry over may exceed acceptable level.

<Fine Powder Coverage Factor of the Porous Ferrite Carrier>

Measurement of the fine powder coverage factor of the porous ferrite carrier core material (porous ferrite particles) described here is carried out as followings. First, an image of the ferrite carrier core material magnified 450 times is photographed by Scanning Electron Microscope (JSM-6100, manufactured by JEOL Ltd.,). Then projected areas of the core material and the fine powder are measured by using an image analysis method followed by calculation according to the expression 3 described below.

Fine powder coverage factor (%)=[(Projected area of fine powder)/(Projected area of core material)]×100 <Expression 3>

In the resin-coated carrier for an electrophotographic developer according to the present invention, only the surface of the porous ferrite core material is coated with a resin. The coating amount of the resin is preferably 0.5 to 5 parts by weight, more preferably 1 to 4 parts by weight and the most preferably 1 to 3 parts by weight in relation to 100 parts by weight of the porous ferrite core material. When the coating amount of the resin is less than 0.5 parts by weight, it is impossible to sufficiently coat the surface of the porous ferrite core material with the resin, the vacancy is not formed with the coated resin layer, and no sufficient weight reduction can be attained. When the coating amount of the resin exceeds 5 parts by weight, the aggregation among the particles occurs, and at the time of endurance printing, the aggregation is disintegrated due to the stress exerted on the carrier to offer a cause for the failures such as the charge variation.

The type of the coating resin is not particularly limited as long as the coating resin does not impregnate into the pores of the porous ferrite core material and enables a resin coating on the surface of the porous ferrite core material. Thus, the coating resin can be appropriately selected depending on the factors such as the toner to be combined with the carrier and the use environment. Accordingly, commercially available resins can be used as the coating resin. Examples of the coating resin include: fluororesins, acryl-styrene resins, acrylic resins, fluoroacrylic resins, polyamide resins, polyester resins, unsaturated polyester resins, silicone resins, epoxy resins, urea resins, phenolic resins and melamine resins; and modified silicone resins obtained by modification with a resin such as an acrylic resin, a polyester resin, an epoxy resin, a polyamide resin, an alkyd resin, a urethane resin or a fluororesin. From the viewpoint of the resin coating method, preferable are such resins that, as described below, are used in particular as resin fine particles, and can form a resin coating through heat melting after being mixed with the porous ferrite core material.

For the purpose of controlling the electric resistance, charge amount and charging rate of the carrier, a conductive agent can be contained in the coating resin. The electric resistance of the conductive agent itself is low, and hence when the additive amount of the conductive agent is too large, a rapid charge leakage tends to occur. Accordingly, the additive amount of the conductive agent is 0.25 to 20.0% by weight, preferably 0.5 to 15.0% by weight and particularly preferably 1.0 to 10.0% by weight in relation to the solid content of the coating resin. Examples of the conductive agent include conductive carbon, oxides such as titanium oxide and tin oxide, and various organic conductive agents.

A charge control agent can be contained in the coating resin. Examples of the charge control agent include various types of charge control agents generally used for toners and various silane coupling agents. The usable types of the charge control agents and the coupling agents are not particularly limited; preferable examples of the usable charge control agents and coupling agents include: charge control agents such as nigrosine dyes, quaternary ammonium salts, organometallic complexes and metal-containing monoazo dyes; and aminosilane coupling agents and fluorosilane coupling agents.

The volume average particle size of the resin-coated carrier for an electrophotographic developer according to the present invention is preferably 20 to 60 μm. With this range, the carrier beads carry over is prevented and satisfactory image quality is obtained. When the volume average particle size is less than 20 μm, unpreferably such a volume average particle size tends to cause the carrier beads carry over. When the volume average particle size exceeds 60 μm, unpreferably such a volume average particle size tends to cause the image quality degradation.

[Volume Average Particle Size (Microtrac)]

The volume average particle size was measured as follows. Specifically, the measurement was conducted with the Microtrac Particle Size Analyzer (Model 9320-X100) manufactured by Nikkiso Co., Ltd. Water was used as a dispersion medium. In a 100-ml beaker, 10 g of a sample and 80 ml of water were placed, and a few drops of a dispersant (sodium hexametaphosphate) were added to the beaker. Next, the mixture thus obtained was subjected to dispersion for 20 seconds with an ultrasonic homogenizer (Model UH-150, manufactured by SMT Co., Ltd.) set at an output power level of 4. Then, the foam formed on the surface of the dispersed mixture was removed and the dispersed mixture is placed as a sample in the measurement apparatus.

The saturation magnetization of the resin-coated ferrite carrier for an electrophotographic developer according to the present invention is preferably 30 to 80 $Am^2/kg$ and more preferably 50 to 70 $Am^2/kg$. When the saturation magnetization is less than 30 $Am^2/kg$, the carrier beads carry over tends to be induced, and when the saturation magnetization exceeds 80 $Am^2/kg$, the ears of the magnetic brush come to be high, and thus unpreferably high image quality is hardly obtained.

[Saturation Magnetization]

Here, the saturation magnetization was measured with an integral-type B-H tracer, Model BHU-60 (manufactured by Riken Denshi Co., Ltd.). An H coil for measuring magnetic field and a 4πI coil for measuring magnetization were inserted between the pole pieces of an electromagnet. In this case, a sample was placed in the 4πI coil. By integrating each of the outputs from the H coil and the 4πI coil while the magnetic field H was being varied by varying the current of the electromagnet, a hysteresis loop was depicted on a sheet of recording paper with the H output on the X-axis and the 4πI coil output on the Y-axis. Here, the measurement conditions were as follows: the sample filling quantity: approximately 1 g; the sample filling cell: inner diameter: 7 mmϕ±0.02 mm and height: 10 mm±0.1 mm; 4πI coil: 30 turns.

The apparent density of the resin-coated carrier for an electrophotographic developer according to the present invention is preferably 1.0 to 2.0 $g/cm^3$, more preferably 1.3 to 1.8 $g/cm^3$ and the most preferably 1.5 to 1.7 $g/cm^3$. When the apparent density is less than 1.0 $g/cm^3$, the carrier is too light in weight and hence the charge imparting capability tends to be degraded. When the apparent density exceeds 2.0 g/cm$^3$, the weight reduction of the carrier is not sufficient and the carrier is poor in durability. The measurement method is the same with the method for the porous ferrite described above.

<Method for Producing Resin-Coated Carrier for an Electrophotographic Developer According to the Present Invention>

The method for producing the resin-coated carrier for an electrophotographic developer according to the present invention is described.

In the method for producing the resin-coated carrier for an electrophotographic developer according to the present invention, for the purpose of producing a porous ferrite core material, first, raw materials are weighed out in appropriate amounts, and then pulverized and mixed with a ball mill, a vibration mill or the like for 0.5 hour or more, preferably, 1 to 20 hours. The raw materials are not particularly limited, but are preferably selected so as to give the composition containing the above-described elements.

The pulverized mixture thus obtained is converted into a pellet with a compression molding machine or the like, and then the pellet is calcined at a temperature of 700 to 1200° C. Alternatively, without using a compression molding machine, after pulverization, the pulverized mixture may be converted into a slurry by adding water thereto, and the slurry may be converted into granules by using a spray dryer. After the calcination, further pulverization is conducted with a ball mill, a vibration mill or the like, then water and, where necessary, a dispersant, a binder and the like are added, the viscosity is adjusted, and then granules are prepared with a spray dryer. In the pulverization after the calcination, pulverization may also be conducted by adding water with a wet ball mill, a wet vibration mill or the like.

The above-described pulverizing machine such as the ball mill or the vibration mill is not particularly limited; however, for the purpose of effectively and uniformly dispersing the raw materials, it is preferable to adopt fine beads having a particle size of 1 mm or less as the media to be used. By regulating the size and the composition of the beads used and the pulverization time, the degree of pulverization can be controlled.

Then, the granulated substance thus obtained is maintained for sintering at a temperature of 800 to 1500° C. for 1 to 24 hours in an oxygen concentration-controlled atmosphere. In this case, a rotary electric furnace, a batch electric furnace, a continuous electric furnace or the like is used, and the atmosphere at the time of sintering may be controlled with respect to the oxygen concentration by introducing an inert gas such as nitrogen or a reducing gas such as hydrogen or carbon monoxide. Additionally, in the case of the rotary electric furnace, sintering may be repeated multiple times under variation of the atmosphere and/or the sintering temperature.

The resulting sintered substance is pulverized and classified. As the classification method, the existing methods such as a pneumatic classification method, a mesh filtration method and a precipitation method are used to regulate the volume average particle size to an intended particle size.

Then, where necessary, by applying low temperature heating to the surface, an oxide film forming treatment is performed and thus electric resistance can be regulated. In the oxide film forming treatment, a common rotary electric furnace, a common batch electric furnace or the like is used to allow the heat treatment to be performed, for example, at 300 to 700° C. The thickness of the oxide film formed by this treatment is preferably 0.1 nm to 5 μm. When the thickness is less than 0.1 nm, the effect of the oxide film layer is small, and when the thickness exceeds 5 μm, the magnetization is decreased or the resistance becomes too high, and thus unpreferably intended properties are hardly obtained. Where necessary, reduction may be performed before the oxide film forming treatment. In this way, a porous ferrite core material (particle) having a pore volume and a peak pore size respectively falling within specific ranges is prepared.

Practically applicable examples of such methods as described above for controlling a pore volume, the peak pore size, the pore size variation and the apparent density of the porous ferrite core material include various methods based on the types of the raw material to be mixed, the pulverization degree of the raw materials, application or nonapplication of calcination, the calcination temperature, the calcination time, the binder amount at the time of granulation by a spray dryer, the sintering method, the sintering temperature, the sintering time and the reduction with a gas such as hydrogen gas and carbon monoxide gas. These controlling methods are not particularly limited; an example of these methods is described below.

Specifically, the use of hydroxide or carbonate as the raw materials to be mixed tends to result in a larger pore volume with a smaller apparent density than the use of oxide; additionally, nonapplication of calcination or a low calcination temperature or a combination of a low sintering temperature and a short sintering time tends to result in a larger pore volume with a smaller apparent density.

The peak pore size tends to be small under the conditions that the pulverization degree of the raw materials used, in particular, the pulverization degree of the raw materials after calcination is enhanced and thus the primary particle size in pulverization is made small. The peak pore size can be made small by the introduction of a reducing gas such as hydrogen or carbon monoxide, rather than the use of an inert gas such as nitrogen at the time of the sintering.

Further, the pore size variation can be made low by making the sintering proceed with uniform degrees of sintering of the raw materials at the time of sintering. Specifically, the use of a rotary electric furnace is preferable to the use of a tunnel continuous furnace because the rotary electric furnace can uniformly apply heat to the raw materials. The pore size variation can also be made low by sharpening the distribution of the pulverized particle size through increasing the degree of pulverization of the raw materials to be used, in particular, the raw materials after calcination.

By using these controlling methods each alone or in combinations thereof, a porous ferrite core material having the intended pore volume, peak pore size and pore size variation can be obtained.

The thus obtained porous ferrite carrier material is coated with a resin. The carrier properties, in particular, the electric properties including the charging property are frequently affected by the materials present on the carrier surface and by the properties and conditions of the carrier surface. Accordingly, by coating the surface of the core material with an appropriate resin, intended carrier properties can be regulated with a satisfactory accuracy. As the method for coating, heretofore known methods such as a brush coating method, a dry method, a spray drying method based on a fluidized bed, a rotary drying method and a dip-and-dry method using a universal stirrer are available; however, preferable is a dry coating method that is capable of efficiently coating the surface of the porous ferrite with a resin without impregnating the resin into the pores of the porous ferrite. The dry coating method as referred to herein means a method in which no solvent is used, fine particles of a resin are used as the coating resin, the fine particles of the resin and the porous ferrite core material are mixed together, and then the coating resin is melted by heating and the surface of the porous ferrite core material is coated with the molten coating resin; as compared to a resin solution in which the resin is diluted, a resin in a molten state is high in viscosity, and hence the impregnation of the resin into the interior of the pores is prevented to enable an efficient coating of the surface with the resin. Examples of the usable production apparatus include: a heating kneader, a heating Henschel mixer, a heating UM mixer, a planetary mixer, a heating fluidized rolling bed and a heating kiln. The heating temperature is varied depending on the resin to be used, and is required to be equal to or higher than the melting point or the glass transition point of the resin to be used; in the cases of the resins such as thermosetting resins or condensation-crosslinking resins, the temperature is required to be increased up to a temperature at which the curing proceeds to a sufficient extent.

<Electrophotographic Developer according to the Present Invention>

Next, the electrophotographic developer according to the present invention is described.

The electrophotographic developer according to the present invention includes the above-described resin-coated carrier for an electrophotographic developer and a toner.

Examples of the toner particle that constitutes the electrophotographic developer of the present invention include a pulverized toner particle produced by a pulverization method and a polymerized toner particle produced by a polymerization method. In the present invention, the toner particle obtained by either of these methods can be used.

The pulverized toner particle can be obtained, for example, by means of a method in which a binder resin, a charge control agent and a colorant are fully mixed together with a mixing machine such as a Henschel mixer, then the mixture thus obtained is melt-kneaded with an apparatus such as a double screw extruder, and the melt-kneaded substance is cooled, pulverized and classified; an external additive is added to the classified product, and then the mixture is mixed with a mixer or the like to yield the pulverized toner particle.

The binder resin that constitutes the pulverized toner particle is not particularly limited. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge control agent, any charge control agent can be used. Examples of the charge control agent for use in positively charged toners may include nigrosine dyes and quaternary ammonium salts. Additionally, examples of the charge control agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsification method. Such a polymerized toner particle can be obtained, for example, as follows: a colorant dispersion liquid in which a colorant is dispersed with a surfactant in water, a polymerizable monomer, a surfactant and a polymerization initiator are mixed in a aqueous medium under stirring to disperse the polymerizable monomer by emulsification in the aqueous medium; the polymerizable monomer thus dispersed is polymerized under stirring for mixing; then, the polymer particles are salted out by adding a salting-out agent; the particles obtained by salting-out are filtered off, rinsed and dried, and thus the polymerized toner particle can be obtained. Then, where necessary, an external additive is added to the dried toner particle.

Further, when the polymerized toner particle is produced, in addition to the polymerizable monomer, the surfactant, the polymerization initiator and the colorant, a fixability improving agent and a charge control agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

The polymerizable monomer used in the production of the polymerized toner particle is not particularly limited; however, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using a silane coupling agent, a titanium coupling agent or the like.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. The used amount of such a surfactant affects the dispersion stability of the monomer, and also affects the environment dependence of the obtained polymerized toner particle, and hence such a surfactant is preferably used within the above-described range in which the dispersion stability of the monomer is ensured and the environment dependence of the polymerized toner particle is hardly excessively affected.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include: natural waxes such as carnauba wax; and olefin waxes such as polypropylene and polyethylene.

Additionally, for a case where the polymerized toner particle used in the present invention contains a charge control agent, the charge control agent used is not particularly limited, and examples of the usable charge control agent include nigrosine dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The volume average particle size of the toner particle produced as described above falls in a range from 2 to 15 μm and preferably in a range from 3 to 10 μm, and the polymerized toner particle is higher in the particle uniformity than the pulverized toner particle. When the volume average particle size of the toner particle is less than 2 μm, the charging ability is degraded to tend to cause fogging or toner scattering; when larger than 15 μm, such a volume average particle size offers a cause for image quality degradation.

Mixing of the carrier and the toner produced as described above can yield an electrophotographic developer. The mixing ratio between the carrier and the toner, namely, the toner concentration is preferably set at 3 to 15% by weight. When the toner concentration is less than 3% by weight, it is difficult to attain an intended image density; when larger than 15% by weight, toner scattering or fogging tends to occur.

A developer obtained by mixing the carrier and the toner produced as described above can be used as a refill developer. In this case, the mixing ratio between the carrier and the toner is such that the amount of the toner is 2 to 50 parts by weight in relation to 1 part by weight of the carrier.

The electrophotographic developer according to the present invention, prepared as described above, can be used in a digital image formation apparatus, such as a copying machine, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is specifically described on the basis of Examples and the like, but the present invention is not limited by the Examples and the like in any way.

Example 1

Raw materials were weighed out so as to give the following composition: MnO: 38 mol %, MgO: 9.5 mol %, $Fe_2O_3$: 52 mol %, and SrO: 0.5 mol %. The weighed out raw materials were pulverized with a dry media mill (vibration mill, stainless steel beads of ⅛ inch in diameter) for 5 hours, and the pulverized substance thus obtained was converted into about 1-mm cube pellets with a roller compactor. As the raw materials for MnO, MgO and SrO, trimanganese tetraoxide, magnesium hydroxide and strontium carbonate were used, respectively. The pellets were subjected to coarse powder removal with a vibration sieve of 3 mm in mesh opening size, and then subjected to removal of fine powder with a vibration sieve of 0.5 mm in mesh opening size. Then, the pellets were heated for calcination at 1000° C. for 3 hours.

Then, the pellets were pulverized to an average particle size of about 5.1 μm with a dry media mill (vibration mill, stainless steel beads of ⅛ inch in diameter). Then, water was added to the pulverized pellets, and the mixture thus obtained was further pulverized for 3 hours with a wet media mill (upright bead mill, stainless steel beads of 1/16 inch in diameter). The particle size (primary particle size in pulverization) of the slurry thus obtained was measured with a Microtrac analyzer, and the volume average particle size $D_{50}$ was 2.41 μm. An appropriate amount of a dispersant was added to the slurry, and for the purpose of ensuring the strength of the granulated particles and realizing a reductive atmosphere in the following sintering step, PVA (10% solution) as a binder was added to the slurry in an amount of 12% by weight in relation to the solid content of the slurry. Then, the thus treated slurry was granulated and dried with a spray dryer, and the obtained particles are regulated in particle size.

The granulated substance obtained as described above was maintained for sintering at 1000° C. for 1 hour in a reductive atmosphere with a rotary electric furnace while the pressure inside the furnace was being maintained at a positive pressure. For the reductive atmosphere, utilized was the thermolysis gas of the dispersant and the binder added at the time of granulation with a spray dryer.

Subsequently, the sintered product was disintegrated and further classified to regulate the particle size, and subjected to separation and removal of low magnetic fractions with magnetic separation to yield a core material composed of porous ferrite particles. The pore volume, the peak pore size, the pore size variation dv of the porous ferrite core material were 70.8 $mm^3/g$, 0.53 μm and 0.32, and further, the apparent density and the fine powder coverage factor were 1.68 $g/cm^3$ and 2.8%, respectively.

Next, 3 parts by weight of silicone resin 1 (condensation-crosslinking silicone resin powder, KR220L, manufactured by Shin-Etsu Chemical Co., Ltd.) was mixed with 100 parts by weight of the above-described porous ferrite core material, and the resulting mixture was stirred and mixed for 30 minutes with a universal mixer.

Next, the thus treated mixture was placed in a heating kneader, increased in temperature from normal temperature up to 240° C. at a rate of 5° C./min, and stirred and kneaded for 2 hours; then the heater was turned off; and the mixture was cooled under stirring for 30 minutes, and then discharged from the apparatus.

Then, the aggregation of the particles of the mixture was disintegrated with a vibration sieve of 200M in mesh opening, and the nonmagnetic fractions were removed with a magnetic separator. Successively, the coarse particles were removed, again with a vibration sieve, to yield a resin-coated carrier in which the surface of the porous ferrite core material was coated with a resin.

Example 2

A resin-coated carrier in which the surface of the porous ferrite core material is coated with a resin was obtained in the same manner as in Example 1 except that an acrylic resin (acrylic resin powder (MMA), BR-73 manufactured by Mitsubishi Rayon Co., Ltd.) was used as the coating resin, and the temperature of the heating kneader was set at 140° C.

Example 3

With respect to the conditions of the pulverization after the calcination, the time for the pulverization with the wet media mill (upright bead mill, stainless steel beads of 1/16 inch in diameter) was altered to 10 hours, and therefore, the volume average particle size $D_{50}$ of the slurry particle size (primary particle size in pulverization) was as fine as 1.62 μm. Then, resulting granulated substance was heated at 700° C. for 2 hours with a rotary electric furnace to remove the dispersant and the organic components such as the binder, and further, maintained for 5 hours under the sintering conditions that the sintering atmosphere was an atmosphere of nitrogen gas, the sintering temperature was 1050° C. and a tunnel electric furnace was used. Subsequently, the sintered product was disintegrated and further classified to regulate the particle size, and subjected to separation and removal of low magnetic fractions with magnetic separation to yield a core material composed of porous ferrite particles.

The pore volume, the peak pore size, the pore size variation dv of the porous ferrite core material were 121.3 $mm^3/g$, 0.54 μm and 0.26, and further, the apparent density and the fine powder coverage factor were 1.48 $g/cm^3$ and 0.7%, respectively.

After that, a resin-coated carrier prepared by resin coating on the surface of a porous ferrite carrier core material is obtained in the same manner as in Example 2.

Example 4

A resin-coated carrier prepared by resin coating on the surface of a porous ferrite carrier core material is obtained in the same manner as in Example 2 except that the sintering temperature was set at 900° C. The pore volume, the peak pore size, the pore size variation dv of the porous ferrite core material were 155.3 $mm^3/g$, 0.55 μm and 0.47, and further, the apparent density and the fine powder coverage factor were 1.31 $g/cm^3$ and 5.8%, respectively.

Example 5

A resin-coated carrier prepared by resin coating on the surface of a porous ferrite carrier core material is obtained in the same manner as in Example 2 except that the sintering temperature was set at 1040° C. The pore volume, the peak pore size, the pore size variation dv of the porous ferrite core material were 56.8 $mm^3/g$, 0.49 μm and 0.48, and further, the apparent density and the fine powder coverage factor were 1.79 $g/cm^3$ and 2.5%, respectively.

Comparative Example 1

With respect to the conditions of the pulverization after the calcination, the time for the pulverization with the wet media mill (upright bead mill, stainless steel beads of 1/16 inch in diameter) was altered to 0.5 hour, and therefore, the volume average particle size $D_{50}$ of the slurry particle size (primary particle size in pulverization) was as coarse as 4.3 μm. Then, the resulting granulated substance was heated at 700° C. for 2 hours with a rotary electric furnace to remove the dispersant and the organic components such as the binder, and further, maintained for 5 hours under the sintering conditions that the sintering atmosphere was an atmosphere of nitrogen gas, the sintering temperature was 1100° C. and a tunnel electric furnace was used. Subsequently, the sintered product was disintegrated and further classified to regulate the particle size, and subjected to separation and removal of low magnetic fractions with magnetic separation to yield a core material composed of porous ferrite particles. The pore volume, the peak pore size, the pore size variation dv of the porous ferrite core material were 70.8 $mm^3/g$, 0.53 μm and 0.32, and further, the apparent density and the fine powder coverage factor were 1.68 $g/cm^3$ and 2.8%, respectively. Subsequently, in the same manner as in Example 1, a resin-coated carrier prepared by resin coating was obtained.

Comparative Example 2

First, 100 parts by weight of the same porous ferrite core material as used in Example 1 and silicone resin 2 (condensation-crosslinking silicone resin composed of T units and D units, weight average molecular weight: about 8000) were prepared. To 45 parts by weight of a solution of the silicone resin (the resin solution concentration was 20% by weight, and hence the solid content was 9 parts by weight; diluting solvent: toluene), an aminosilane coupling agent (γ-aminopropyltrimethoxysilane) was added in an amount of 10% by weight in relation to the resin solid content to yield a resin solution. Then, 100 parts by weight of the above-described porous ferrite core material and the resin solution were mixed under stirring at 60° C. under a reduced pressure of 4.0 kPa, and thus the resin was made to penetrate into and fill in the interior of the porous ferrite core material while the toluene was being evaporated.

After making sure of the sufficient evaporation of the toluene, the mixture was further continuously stirred for 30 minutes to remove the toluene almost completely. Then, the mixture was taken out from the filling apparatus and transferred into a vessel, and the vessel was placed in a hot air heating oven to conduct a heat treatment at 220° C. for 2 hours.

Then, the heat treated mixture was cooled down to room temperature, and the ferrite particles in which the resin was cured were taken out, the aggregation of the particles was disintegrated with a vibration sieve of 200M in mesh opening, and the nonmagnetic fractions were removed with a magnetic separator. Successively, the coarse particles were removed, again with a vibration sieve, and thus a resin-filled ferrite carrier was obtained.

Comparative Example 3

A resin-coated carrier prepared by resin coating on the surface of a porous ferrite carrier core material is obtained in the same manner as in Example 2 except that the sintering temperature was set at 800° C. The pore volume, the peak pore size, the pore size variation dv of the porous ferrite core material were 229.5 $mm^3/g$, 0.49 μm and 0.21, and further, the apparent density and the fine powder coverage factor were 0.98 $g/cm^3$ and 12.8%, respectively.

Comparative Example 4

The granulated substance obtained in Example 2 was heated for 2 hours at 700° C. in a rotary electric furnace to remove the dispersant and the organic components such as the binder, and further, maintained for 5 hours under the sintering conditions that the sintering atmosphere was an atmosphere of nitrogen gas, the sintering temperature was 1200° C. and a tunnel electric furnace was used. Subsequently, the sintered product was disintegrated and further classified to regulate the particle size, and subjected to separation and removal of low magnetic fractions with magnetic separation to yield a core material composed of porous ferrite particles. The pore volume, the peak pore size, the pore size variation dv of the porous ferrite core material were 18.4 $mm^3/g$, 0.65 μm and 0.73, and further, the apparent density and the fine powder coverage factor were 2.21 $g/cm^3$ and 0.3%, respectively. After that, resin-coated carrier prepared by resin coating was obtained in the same manner as in Example 2.

For each of the carriers obtained in Examples 1 to 5 and Comparative Examples 1 to 4, the pore volume, the peak pore size, the pore size variation dv, the apparent density of the porous ferrite core material, the fine powder coverage factor, distinction between coating or filling, the type of the resin and the amount of the resin are shown in Table 1. Additionally, for each of the carriers obtained in Examples 1 to 5 and Comparative Examples 1 to 4, the average volume particle size, the saturation magnetization, the apparent density, the results related to the forced stirring test (the charge amounts before and after the forced stirring and the rate of the charge variation between before and after the forced stirring), the carrier strength, the charge variation property and the evaluation of the carrier strength property are shown in Table 1. The forced stirring test (the charge amounts before and after the forced stirring and the rate of the charge variation between before and after the forced stirring) and the measurement method of the carrier strength are as follows. The other measurement methods are as described above.

[Charge Amount]

The charge amount was obtained from the measurement of a mixture composed of a carrier and a toner with a suction-type charge amount measurement apparatus (Epping q/m-meter, manufactured by PES-Laboratorium). The toner used was a commercially available negatively polar toner (cyan toner for use in DocuPrintC3530, manufactured by Fuji Xerox Co., Ltd., average particle size: about 5.8 μm) used in a full-color printer, and the amount of the developer was regulated to be 10 g and the toner concentration was regulated to be 10% by weight. The thus prepared developer was placed in a 50-cc glass bottle and the glass bottle was housed and fixed in a cylindrical holder of 130 mm in diameter and 200 mm in height. Thus, the developer was stirred for 30 minutes with a Turbula mixer manufactured by Shinmaru Enterprises Corp., and the charge amount measurement was conducted by using a 635M screen.

[Forced Stirring Test]

The same commercially available negatively polar toner (cyan toner for use in DocuPrintC3530, manufactured by Fuji Xerox Co., Ltd., average particle size: about 5.8 μm) as described above was used, and the amount of the developer was regulated to be 20 g and the toner concentration was regulated to be 10% by weight. The thus prepared developer was placed in a 50-cc glass bottle, the glass bottle was placed in a paint shaker manufactured by Asada Iron Works Co., Ltd., and the developer was stirred for 10 hours. After completion of the stirring, the developer was take out, the toner was sucked by using a 635M screen, and thus only the carrier was taken out. The total amount of the obtained carrier was measured by the above-described charge amount measurement method and the obtained charge amount was defined as the charge amount after forced stirring.

[Charge Amount Variation Rate]

The charge amount variation rate was derived on the basis of the following formula.

Charge amount variation rate (%)=[(Charge amount of the carrier after forced stirring)/(charge amount of the carrier before forced stirring)]×100 [Expression 4]

[Carrier Strength]

In a 50-cc glass bottle, 20 g of a carrier was placed, and the glass bottle was shaken for 10 hours with a paint shaker to stir the carrier. When the cracking and the abrasion of the carrier particles occur and thus fine particles are generated due to the stirring stress, the average particle size of the carrier, after the stirring, becomes small. With decreasing strength of the carrier, the abrasion of the carrier occurs to an increasing extent and the fine particles of the carrier are generated in an increasing amount to reduce the average particle size. Accordingly, the rate of the variation of the average particle size between before and after the stirring was adopted as the index of the carrier strength. The average particle size was defined as the volume average particle size measured with the above-described Microtrac Particle Size Analyzer (Model 9320-X100) manufactured by Nikkiso Co., Ltd., and the particle size variation rate was derived as the carrier strength as follows.

Carrier strength(particle size variation rate)=$[(D_0-D_1)/D_0]\times100(\%)$ [Expression 5]

wherein $D_0$: the volume average particle size of the carrier before the stirring, and $D_1$: the volume average particle size of the carrier after the stirring.

According to the result of a measurement above, weight reduction (the apparent density), the fine powder coverage factor, carrier strength property and charging property are evaluated. The results were evaluated according to four-grade system, Very Good, Good, Acceptable and Not Good. The evaluation result is shown in Table 2.

[Evaluation Criteria of Weight Reduction (Apparent Density)]

Very Good: 1.30 g/cm$^3$ or more and less than 1.80 g/cm$^3$

Good: 1.00 g/cm$^3$ or more and less than 1.30 g/cm$^3$; or 1.80 g/cm$^3$ or more and less than 2.00 g/cm$^3$ Acceptable: 0.90 g/cm$^3$ or more and less than 1.00 g/cm$^3$; or 2.00 g/cm$^3$ or more and less than 2.10 g/cm$^3$ Not Good: less than 0.90 g/cm$^3$; or 2.10 g/cm$^3$ or more

[Evaluation Criteria of Fine Powder Coverage Factor]

Very Good: less than 3.0%

Good: 3.0% or more and less than 6.0%

Acceptable: 6.0% or more and less than 10.0%

Not Good: 10.0% or more

[Evaluation Criteria of Charge Variation Property]

The evaluation criteria of the charge variation property are as follows.

Very Good: 90% or more and less than 110%

Good: 80% or more and less than 90%; or 110% or more and less than 130%

Acceptable: 70% or more and less than 80%; or 130% or more and less than 150%

Not Good Less than 70%; or 150% or more

[Evaluation Criteria of Carrier Strength Property]

The evaluation criteria of the carrier strength property are as follows.

Very Good: Less than 0.5%

Good: 0.5% or more and less than 1.0%

Acceptable: 1.0% or more and less than 5.0%

Not Good: 5.0% or more

TABLE 1

| | Properties of the porous ferrite core material | | | | | | | |
|---|---|---|---|---|---|---|---|---|
| | | | | | Fire powder | | Resin | |
| | Pore volume (mm$^3$/g) | Peak pore size (μm) | Pore size Variation dv | Apparent density (g/cm$^3$) | coverage factor (%) | Coating or filling | Type | Amount (parts by weight) *1 |
| Example 1 | 70.8 | 0.53 | 0.32 | 1.68 | 2.8 | Coating | Silicone resin 1 | 3.0 |
| Example 2 | 70.8 | 0.53 | 0.32 | 1.68 | 2.8 | Coating | Acrylic resin | 3.0 |
| Example 3 | 121.3 | 0.54 | 0.26 | 1.48 | 0.7 | Coating | Acrylic resin | 3.0 |
| Example 4 | 155.3 | 0.55 | 0.47 | 1.31 | 5.8 | Coating | Acrylic resin | 3.0 |
| Example 5 | 56.8 | 0.49 | 0.48 | 1.79 | 2.5 | Coating | Acrylic resin | 3.0 |
| Comparative Example 1 | 112.5 | 1.56 | 1.32 | 1.31 | 1.0 | Coating | Silicone resin 1 | 3.0 |
| Comparative Example 2 | 70.8 | 0.53 | 0.32 | 1.68 | 2.8 | Filling | Silicone resin 2 | 9.0 |
| Comparative Example 3 | 229.5 | 0.49 | 0.21 | 0.98 | 12.8 | Coating | Acrylic resin | 3.0 |
| Comparative Example 4 | 18.4 | 0.65 | 0.73 | 2.21 | 0.3 | Coating | Acrylic resin | 3.0 |

| | Properties of the carrier | | | | | | |
|---|---|---|---|---|---|---|---|
| | | | | Charge amount | | | |
| | Volume average particle size (μm) | Saturation magnetization (Am$^2$/kg) | Apparent density (g/cm$^3$) | Before forced stirring (μC/g) | After forced stirring (μC/g) | Change amount variation rate (%) | Carrier strength (%) |
| Example 1 | 37.9 | 70 | 1.65 | 33.0 | 36.0 | 109 | 0.4 |
| Example 2 | 39.2 | 69 | 1.63 | 41.0 | 37.7 | 92 | 0.4 |
| Example 3 | 39.1 | 68 | 1.40 | 39.7 | 38.4 | 97 | 0.4 |
| Example 4 | 37.5 | 69 | 1.24 | 35.0 | 30.1 | 86 | 0.7 |
| Example 5 | 39.0 | 71 | 1.77 | 42.5 | 34.4 | 81 | 0.3 |
| Comparative Example 1 | 37.2 | 70 | 1.38 | 16.1 | 8.9 | 55 | 10.2 |
| Comparative Example 2 | 38.9 | 67 | 1.80 | 32.1 | 61.0 | 190 | 0.2 |
| Comparative Example 3 | 36.3 | 64 | 0.93 | 29.0 | 15.3 | 53 | 15.4 |
| Comparative Example 4 | 39.9 | 73 | 2.14 | 46.0 | 36.1 | 78 | 0.1 |

*1 Amount in relation to 100 parts by weight of the porous ferrite core material

TABLE 2

| | Evaluations | | | |
|---|---|---|---|---|
| | Weight reduction | Fine powder coverage factor | Change amount variation rate | Carrier strength |
| Example 1 | Very Good | Very Good | Very Good | Very Good |
| Example 2 | Very Good | Very Good | Very Good | Very Good |
| Example 3 | Very Good | Very Good | Very Good | Very Good |
| Example 4 | Good | Good | Good | Good |
| Example 5 | Very Good | Very Good | Good | Very Good |
| Comparative Example 1 | Very Good | Very Good | Not Good | Not Good |
| Comparative Example 2 | Good | Very Good | Not Good | Very Good |
| Comparative Example 3 | Acceptable | Not Good | Not Good | Not Good |
| Comparative Example 4 | Not Good | Very Good | Acceptable | Very Good |

As can be seen from the results shown in Tables 1 and 2, because each of the resin-coated carriers shown in Examples 1 to 5 maintain a preferable range of the apparent density and the carrier strength, weight reduction is achieved, and further, because charging amount variation after forced stirring and the fine powder coverage factor are small, charging property in endurance printing is made stable in the practical use, i.e. it is easily assumed that good image quality without defective image such as carrier beads carry over, toner scattering and fog can be obtained stably.

On the other hand, the carriers shown in Comparative Examples 1 to 4 are inferior in evaluation of weight reduction, the fine powder coverage factor, carrier strength and charging amount variation because each properties of the porous ferrite carrier core material are not in proper range. As a result, it is easily assumed in the practical use that defective image such as tonner scattering or fog caused by carrier beads carry over, charging amount variation in endurance printing, chipping and cracking of carrier may be promoted and it makes stable maintenance of good image hard.

The resin-coated carrier for an electrophotographic developer according to the present invention can achieve weight reduction, prevention of carrier beads carry over, improved carrier strength and stable charging amount property in endurance printing. As a result, the electrophotographic developer using the resin-coated carrier is excellent in durability and enables the extension of the operating life to be attained.

Therefore, the present invention can be widely used in the fields associated with full-color machines required to be high in image quality and high speed machines required to be satisfactory in the reliability and durability in image maintenance.

The invention claimed is:

1. A resin-coated carrier for an electrophotographic developer, wherein the carrier has a coated resin layer on the surface of a porous ferrite core material, and the pore volume and the peak pore size of the porous ferrite core material are 55 to 160 $mm^3/g$ and 0.2 to 0.7 μm, respectively, and wherein the pores of the porous ferrite core material are not impregnated with a resin.

2. The resin-coated carrier for an electrophotographic developer according to claim 1, wherein a pore size variation Dv represented by the following Formula 1 in a pore size distribution of the porous ferrite core material is 1.0 or less:

$$Dv=|d_{84}-d_{16}|/2 \quad 1$$

wherein pore size is measured using a mercury porosimeter and is defined as a percentage of a maximum amount (100%) of intruded mercury at 200 MPa, for a given sample, and $d_{16}$: is the pore size when an intrusion amount reaches 16% of the maximum amount of intruded mercury, and $d_{84}$: is the pore size when an intrusion amount reaches 84% of the maximum amount of intruded mercury.

3. The resin-coated carrier for an electrophotographic developer according to claim 1, wherein an apparent density of the porous ferrite carrier core material is 1.0 to 2.0 $g/cm^3$.

4. The resin-coated carrier for an electrophotographic developer according to claim 1, wherein a coating amount of the coated resin layer is 0.5 to 5 parts by weight in relation to 100 parts by weight of the porous ferrite core material.

5. The resin-coated carrier for an electrophotographic developer according to claim 1, wherein a volume average particle size is 20 to 60 μm.

6. The resin-coated carrier for an electrophotographic developer according to claim 1, wherein a saturation magnetization is 30 to 80 $Am^2/kg$.

7. The resin-coated carrier for an electrophotographic developer according to claim 1, wherein an apparent density of the resin-coated carrier is 1.0 to 2.0 $g/cm^3$.

8. The resin-coated carrier for an electrophotographic developer according to claim 1, wherein the coated resin layer is formed by a dry coating method.

9. An electrophotographic developer comprising the resin-coated carrier according to claim 1 and a toner.

10. The electrophotographic developer according to claim 9, is a refill developer.

11. A resin-coated carrier for an electrophotographic developer, wherein the carrier has a coated resin layer on the surface of a porous ferrite core material, the pore volume and the peak pore size of the porous ferrite core material are 55 to 160 $mm^3/g$ and 0.2 to 0.7 μm, respectively, the pores of the porous ferrite core material are not impregnated with a resin, and a fine powder coverage factor of the porous ferrite carrier core material is greater than 0% and 6.0% or less;

wherein "fine powder" means a ferrite powder particle size of less than about 2 μm, the composition of the ferrite powder being the same as the porous ferrite core material.

12. The resin-coated carrier of claim 11, wherein the powder particle size is less than about 1 μm.

* * * * *